US010646039B2

(12) United States Patent
Weber et al.

(10) Patent No.: US 10,646,039 B2
(45) Date of Patent: May 12, 2020

(54) STORAGE COMPARTMENT THAT CAN BE INSERTED INTO A CABINET ELEMENT

(71) Applicant: Peka-Metall AG, Mosen (CH)

(72) Inventors: Bernhard Weber, Beinwil am See (CH); Franz Meyer, Hochdorf (CH)

(73) Assignee: PEKA-METALL AG, Mosen (CH)

( * ) Notice: Subject to any disclaimer, the term of this patent is extended or adjusted under 35 U.S.C. 154(b) by 0 days.

(21) Appl. No.: 16/309,197

(22) PCT Filed: Jul. 3, 2017

(86) PCT No.: PCT/EP2017/066435
§ 371 (c)(1),
(2) Date: Dec. 12, 2018

(87) PCT Pub. No.: WO2018/007286
PCT Pub. Date: Jan. 11, 2018

(65) Prior Publication Data

US 2019/0307247 A1 Oct. 10, 2019

(30) Foreign Application Priority Data

Jul. 4, 2016 (EP) ..... 16177679

(51) Int. Cl.
*A47B 96/02* (2006.01)
*A47B 88/90* (2017.01)

(52) U.S. Cl.
CPC ..... *A47B 96/021* (2013.01); *A47B 88/9418* (2017.01)

(58) Field of Classification Search
CPC ... A47B 96/021; A47B 88/9418; A47B 88/00; A47B 96/02; B65D 7/02; B65D 7/00; B65D 7/06; B65D 7/08
See application file for complete search history.

(56) References Cited

U.S. PATENT DOCUMENTS 813,944 A 2/1906 Bubar
2,488,710 A 11/1949 Cooper et al.
2,731,167 A * 1/1956 Arlington ..... B65D 7/06 220/4.21

(Continued)

OTHER PUBLICATIONS

International Search Report & Written Opinion issued in corresponding application No. PCT/EP2017/066435 dated Sep. 11, 2017, 11 pages.

*Primary Examiner* — Ko H Chan
(74) *Attorney, Agent, or Firm* — Pearne & Gordon LLP

(57) ABSTRACT

A storage compartment is formed from a blank made of sheet metal and comprises a base part and edge regions surrounding the base part, which edge regions are bent upwards by about 90° with respect to the base part. The upwardly bent edge regions are equipped with receiving and holding means, in each of which a plate-shaped element is insertable and is held. One each of a first edge region and a second edge region form a first side surface and a second side surface. The first side surface serves as a supporting surface for the plate-shaped element. The second side surface covers the frontal surface of the plate-shaped element. Furthermore, a projecting element is provided in the second side surface. The plate-shaped element is held between the supporting surface and the projecting element.

7 Claims, 8 Drawing Sheets

(56) References Cited

U.S. PATENT DOCUMENTS

| | | | | | |
|---|---|---|---|---|---|
| 3,207,357 | A * | 9/1965 | Schmitt | B65D 5/28 | 220/62 |
| 3,497,127 | A * | 2/1970 | Theodor | B65D 1/225 | 220/7 |
| 3,675,808 | A * | 7/1972 | Brink | B65D 1/225 | 220/7 |
| 3,831,799 | A * | 8/1974 | Nutt | B65D 7/24 | 220/4.31 |
| 3,955,703 | A * | 5/1976 | Zebarth | B65D 1/225 | 220/6 |
| 4,002,287 | A * | 1/1977 | Saveth | B65D 5/324 | 229/122.23 |
| 5,487,504 | A * | 1/1996 | Baird | B65D 5/001 | 229/120.17 |
| 6,027,017 | A * | 2/2000 | Kuhn | B65D 5/5495 | 229/120.011 |
| 6,443,545 | B1 * | 9/2002 | Woerner | A47B 88/9418 | 312/263 |
| 9,611,066 | B2 * | 4/2017 | Bevier | B65D 5/323 | |

* cited by examiner

FIG. 7
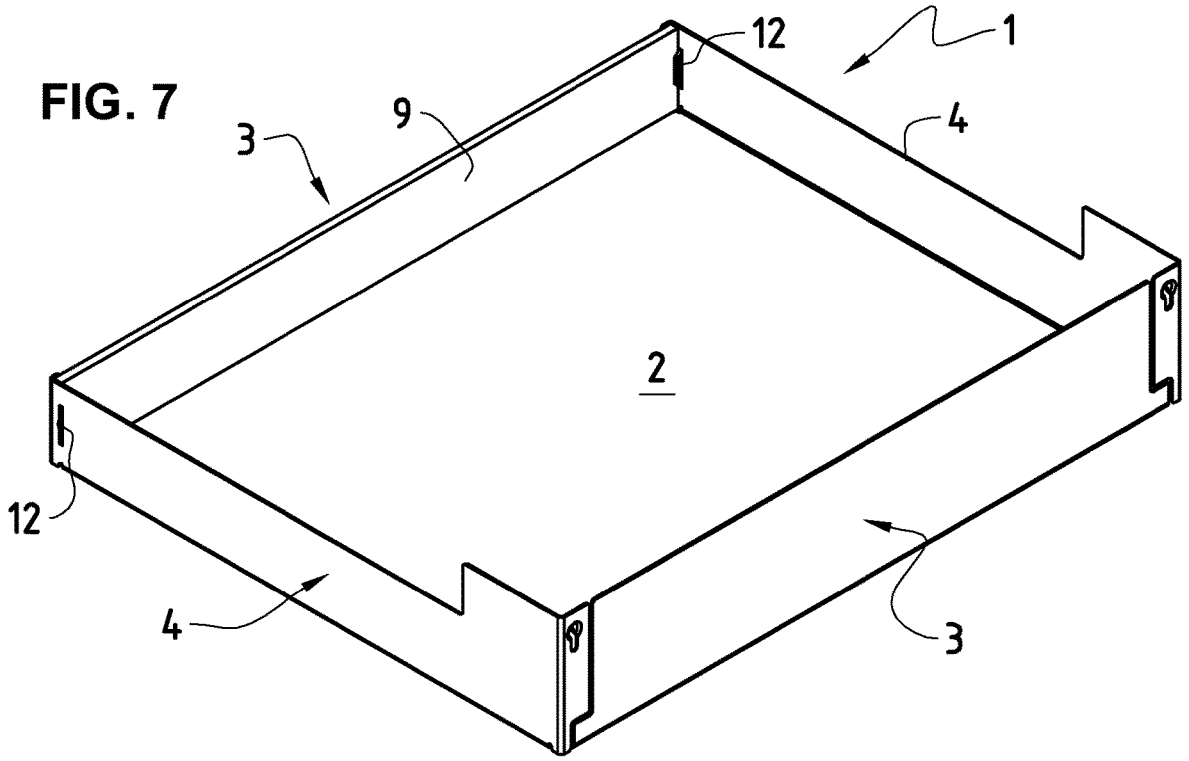
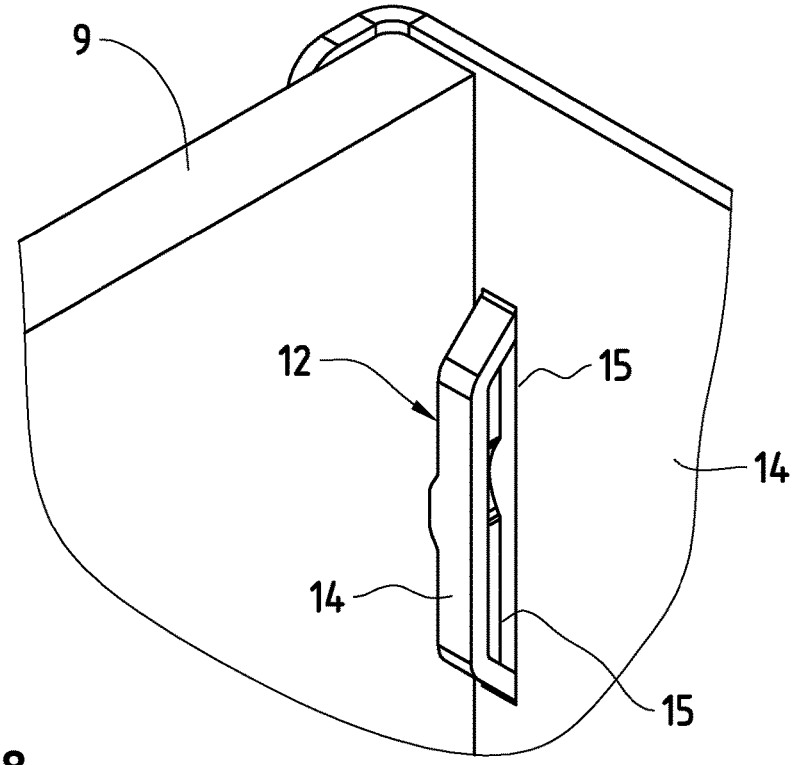
FIG. 8

STORAGE COMPARTMENT THAT CAN BE INSERTED INTO A CABINET ELEMENT

The present invention relates to a storage compartment, which is insertable into a cabinet element, which is formed from a blank of sheet metal, comprising a base part and edge regions surrounding the base part, which edge regions are bent upwards by about 90° with respect to the base part, and the upwardly bent edge regions are equipped with receiving and holding means, in each of which receiving and holding means a plate-shaped element is insertable and is held and forms a wall of the storage compartment.

Storage compartments of this kind are known. In these storage compartments formed from a blank of sheet metal, side walls and/or a rear wall, for example, are supposed to be inserted, whereby a storage compartment is obtained with high side, or respectively rear, walls without these having to be formed from sheet metal. These side walls could consist of any material; for example glass plates could be used.

Arrangements have to be made in the storage compartments, respectively in the blank of sheet metal, so that these plates forming the walls can be correspondingly held. For this purpose grooves can be formed through additional bends in the blank of sheet metal in the base part, in which grooves the plates can be inserted. In addition it is necessary furthermore in many cases for corresponding grooves also to be made in the corner regions of the edge regions surrounding the base part, which here too can be obtained through additional bends in the corresponding sheet metal region, whereby these bends forming the corresponding grooves on the storage compartment are well visible from the outside, which is often felt to be objectionable from an aesthetic viewpoint.

These additional bends in the blank of sheet metal for formation of the grooves for receiving plates forming the side walls require moreover additional work steps, which makes the production of these storage compartments more complicated and costly. The punching and bending tools have a complicated construction which makes their production correspondingly more expensive.

The object of the present invention is thus to design a storage compartment in such a way that the receiving and holding means for a plate-shaped element, which forms a corresponding side wall or rear wall of the storage compartment, are producible as simply as possible and fulfil the aesthetic requirements.

This object is achieved according to the invention in that one each of a first and a second edge region form a corner region of the storage compartment with a first side surface and a second side surface, in that the first side surface serves as a supporting surface for a plane side of the plate-shaped element inserted in the storage compartment, in that the second side surface covers the frontal surface of the plate-shaped element at least over a portion of the height, in which second side surface a projecting element is provided in such a way that the inserted plate-shaped element comes to lie between supporting surface and projecting element and the supporting surface and the projecting element form the receiving and holding means.

With this solution the desired storage compartment can be produced in the simplest way. With few work steps a blank can be obtained from a metal sheet, which is achieved in an advantageous way through a punching process. During this punching process, the projecting elements can be introduced in the blank. Afterwards only the bending steps have to be carried out. The plate-shaped element can then be inserted in a simple way between the supporting surface and the projecting element, whereby, on the one hand, higher walls can be obtained on the storage compartment, and, on the other hand, the storage compartment is upgraded in aesthetic respect.

Preferably, the first side surface is formed by the first edge region and bends provided on the second edge region, and the second side surface is formed by the second edge region. An optimal design of the corner region of the storage compartment is thereby achieved.

Preferably, the projecting element in the second edge region is producible through a cutting and bending out process, which greatly simplifies the manufacture.

Preferably, the projecting element is designed as crosspiece, which is formed by two parallel cuts made in the second edge region, which cuts form the longitudinal sides of the crosspiece, and which crosspiece remains connected by its narrow sides to the second edge region, and in that the crosspiece is bent up out of the surface of the second edge region. This embodiment of the projecting element can be obtained in one work step. The thus designed narrow crosspiece and the developed slot appear to the human eye to be very discreet; the aesthetics remain ensured.

Another preferred embodiment of the invention consists in that the crosspiece is provided with a protuberance on the longitudinal side pointing toward the supporting surface of the first edge region. By means of this protuberance the plate-shaped element held by the crosspiece is fixed in an optimal way.

The bent-up region of the crosspiece can be bent back toward the plate-shaped element. By means of this bending, the plate-shaped element can be held in a simple way, free of play, in the storage compartment.

The storage compartment is provided with suspension devices on the edge regions. These suspension devices make it possible for the storage compartment to be held in a sliding frame, for example, which is able to be pushed into, and pulled out of, a corresponding cabinet element.

The metallic sheet from which the storage compartment is produced can be a chromium steel sheet, whereby the storage compartment does not need any additional surface treatments.

Especially attractive aesthetics can be achieved for the storage compartment if the inserted plate-shaped elements are made of wood.

Embodiments of the present invention will be explained more closely in the following, by way of example, with reference to the attached drawings.

FIG. 7 shows in a spatial representation a third embodiment of a storage compartment according to the invention;

FIG. 8 shows in a spatial representation a partial view of the projecting element formed by the crosspiece;

Figures 1, 2:
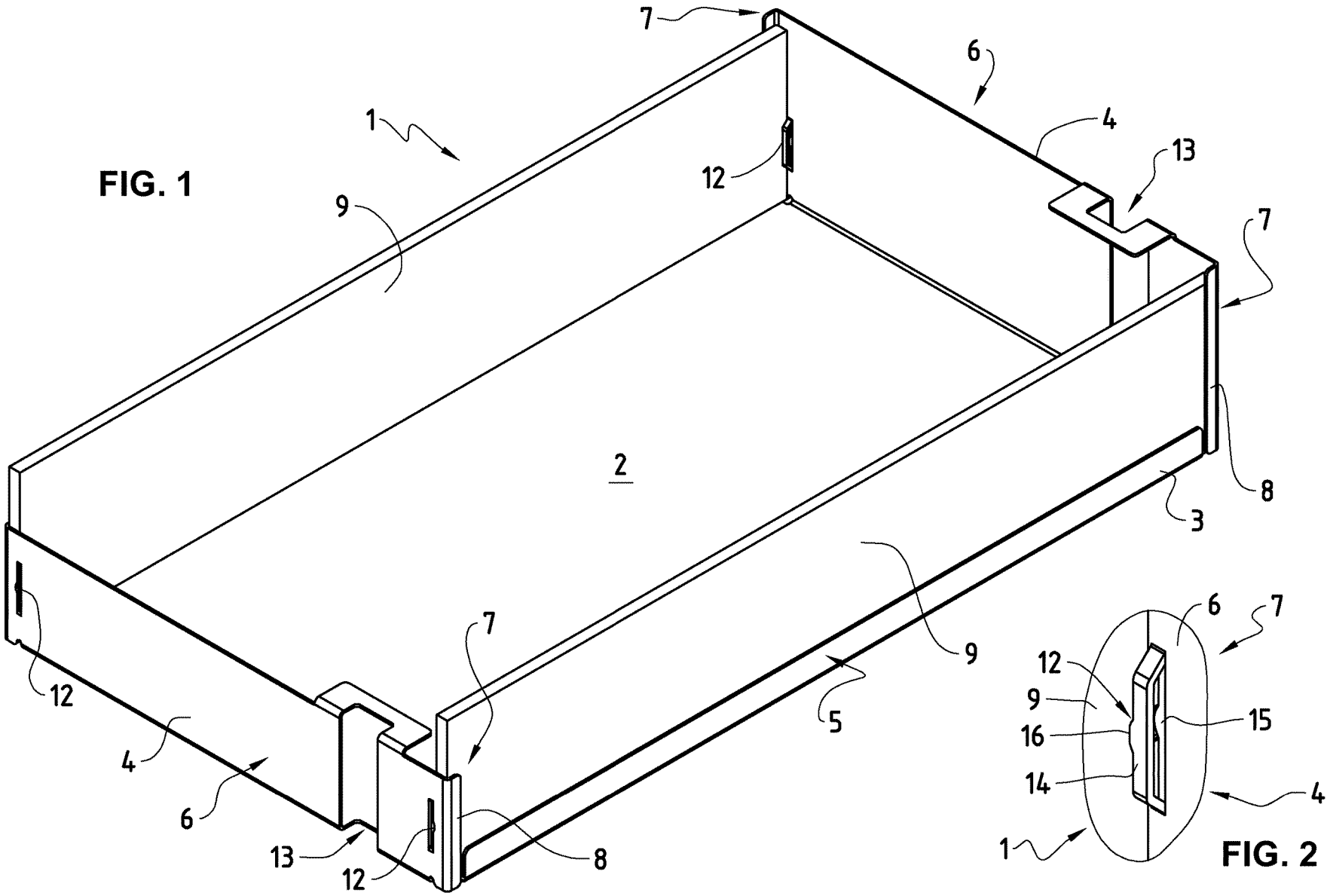
FIG. 1 shows in a spatial representation a first embodiment of a storage compartment according to the invention with inserted plate-shaped elements.
FIG. 2 shows in a spatial representation a partial view of the projecting element designed as crosspiece.

FIG. 1 shows a first embodiment of a storage compartment 1 according to the invention, which, as will be described later, is formed from a blank of sheet metal. This storage compartment 1 comprises a base part 2 and the first edge regions 3 and second edge regions 4 surrounding the base part. These first edge regions 3 and second edge regions 4 are bent upward by about 90° with respect to the base part 2. The bent upward first edge region 3 forms a first side surface 5. The bent upward second edge region 4 forms a second side surface 6. The first side surface 5 and the second side surface 6 each form, for their part, a corner region 7 of the storage compartment 1.

As can be seen furthermore from FIG. 1, bends 8 have been made on the second edge region 4 of the storage compartment 1, which bends form, together with the first edge region 3, the first side surface 5. Inserted in the side regions of the storage compartment 1 are plate-shaped elements 9. These plate-shaped elements 9 support themselves with a plate side on the first side surface 5 of the storage compartment 1; they each form a side wall. The frontal surfaces 11 of the plate-shaped element 9 are covered by the second side surface 6 over a portion of the height. So that the plate-shaped element 9 remains leaning against each of the first side surfaces 5 serving as supporting surface, a projecting element 12 is provided in the respective second side surface 6, which will be described in detail later. The respective inserted plate-shaped element 9 is thereby held between the supporting surfaces, which are formed by the first edge region 3 and the bends 8 of the second edge region 4, and the projecting element 12. With this embodiment a storage compartment 1 is obtained whose basic structure is formed by sheet metal, into which plate-shaped elements 9 serving as side walls can be inserted, which form the side walls of the storage compartment 1. The metal sheet, out of which the storage compartment 1 is formed, can be a chromium steel sheet, for example, but of course other suitable materials can be used, which are able to be punched and bent in an advantageous way. The inserted plate-shaped elements 9 can be made of any material; preferably used is a material corresponding to the aesthetic conceptions of the final user. A material which fulfils these preconditions is, for example, wood or exotic or precious wood.

The front side and end side of the storage compartment 1 are formed by the respective second edge region 4. Suspension devices 13 can be formed in these second edge regions 4 in a known way. Via these suspension devices 13 the storage compartment 1 can be put in a frame, for example, and can be fixed at any desired height, which frame is designed, for example, as cabinet drawer and is able to be pushed into, and pulled out of, a cabinet element.

FIG. 2 shows, in an enlarged representation, a corner region 7 of the storage compartment 1 according to FIG. 1. This corner region 7 is represented by the second edge region 4, which forms the second side surface 6, and the plate-shaped element 9. Provided in the second side surface 6 is the projecting element 12. This projecting element 12 consists of a crosspiece 14, which is formed by two parallel cuts 15 made in the second edge region 4, which completely penetrate the metal sheet forming the second edge region 4, by means of which the longitudinal sides of the crosspiece 14 are formed. The crosspiece 14 remains connected by its narrow sides to the second edge region 4. The crosspiece 14 is bent upward out of the surface of the second edge region 4. The projecting element 12 is formed by this bent up crosspiece 14.

The crosspiece 14 is provided with a protuberance 16 on the longitudinal side pointing toward the plate-shaped element 9.

After the insertion of the plate-shaped element 9, the crosspiece 14 can be bent toward the plate-shaped element 9. The plate-shaped element 9 is then pressed against the first side surface 5 (FIG. 1) by the crosspiece 14 and in particular by the protuberance 16. The plate-shaped element 9 is thereby held, in a way free of play, in the storage compartment 1. The bending of the crosspiece 14 toward the plate-shaped element 9 can be achieved in a simple way by means of a screwdriver, for example, which is inserted in the slot arising between the cuts 15 in the sheet metal and tilted.

Figure 3:
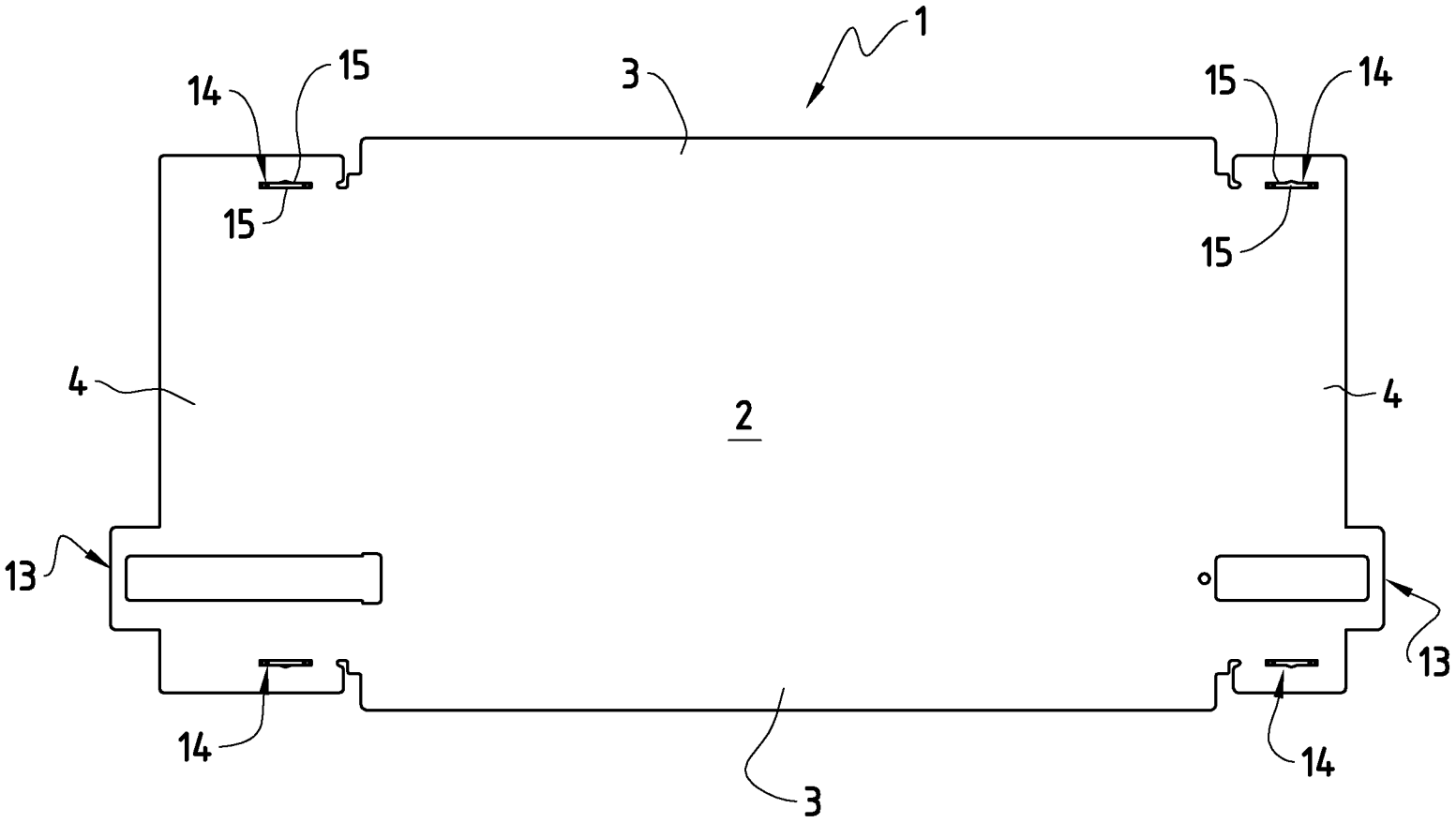
FIG. 3 shows a view of the blank of sheet metal for producing the storage compartment according to FIGS. 1 and 2.

Shown in FIG. 3 is the blank 17 of sheet metal, with which the basic structure of the storage compartment 1 is formed. This sheet metal blank is obtained by a punching process, whereby all first edge regions 3 and second edge regions 4 are formed on the base part 2. By means of this punching process the suspension devices 13 are also made in the sheet metal blank. Likewise each of the two cuts 15 are made, by means of which the respective crosspiece 14 is formed. Then in a known way the edge regions 3, 4 and the other parts required are bent, whereby the basic structure of the storage compartment 1, as it is shown in FIG. 1, is obtained.

Figure 4:
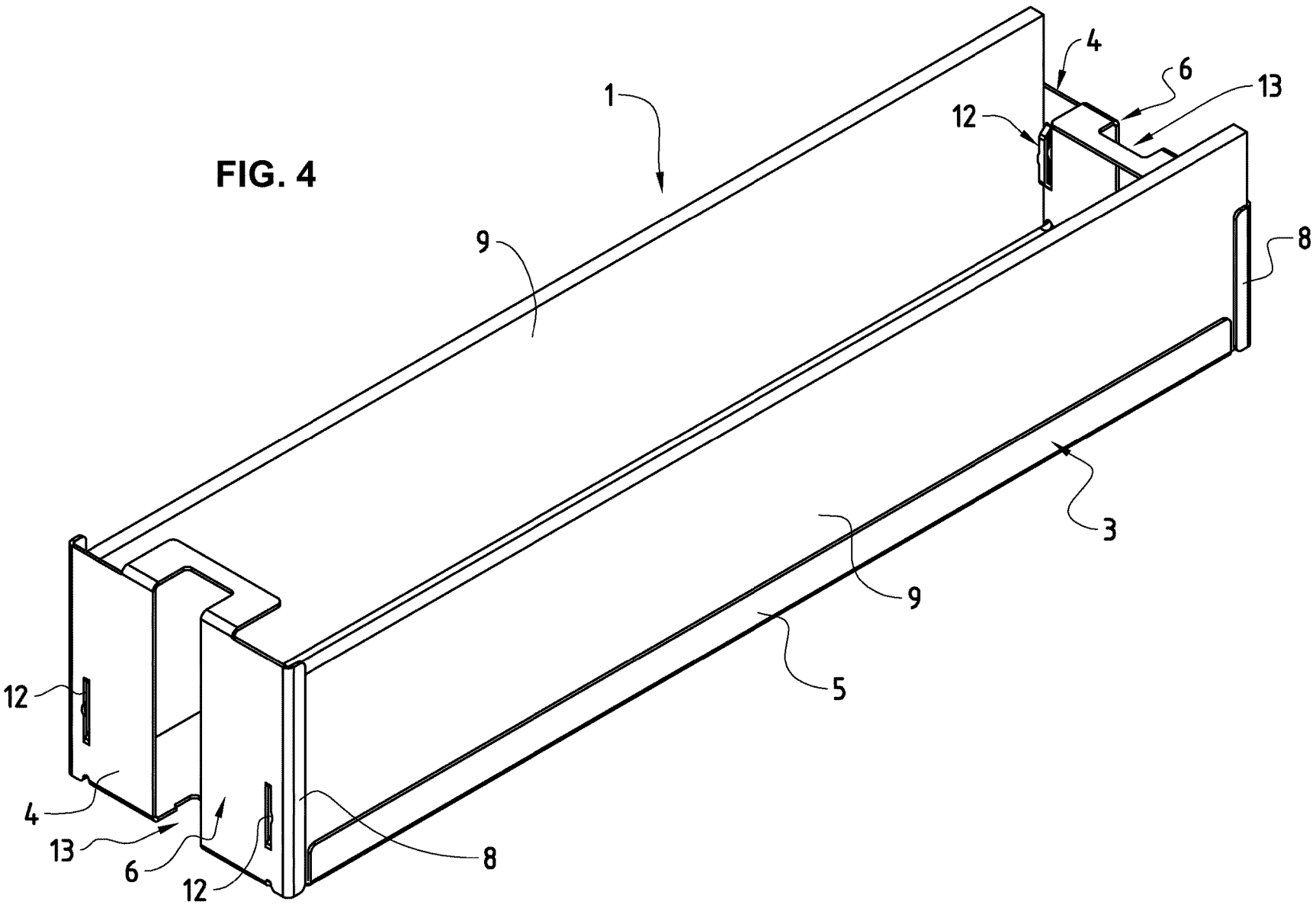
FIG. 4 shows in a spatial representation a second embodiment of a storage compartment according to the invention.

FIG. 4 shows a second embodiment of a storage compartment 1 according to the invention. The basic structure of this storage compartment 1 is again of sheet metal. The first edge region 3 and the second edge region 4 are correspondingly bent upward. The first side surface 5 is formed by the first edge region 3 and the bends 8 of the second edge region 4. The second side surface 6 is formed by the second edge region 4. Provided on the second edge regions 4 are again the projecting elements 12. Inserted into the storage compartment 1 are again two plate-shaped elements 9, which come to rest on the respective first side surface 5 and which are pressed by the projecting elements 12 against the side surface 5. These two plate-shaped elements 9 can be made of any desired material, wood being especially suitable, for aesthetic reasons. These two plate-shaped elements 9 thereby form here too the two side walls of the storage compartment 1.

Provided on the two second edge regions 4, which form the end walls of the storage compartment 1, are again suspension devices 13, whereby the storage compartment 1 is able to be inserted in a corresponding support, for example a supporting frame.

Figure 5:
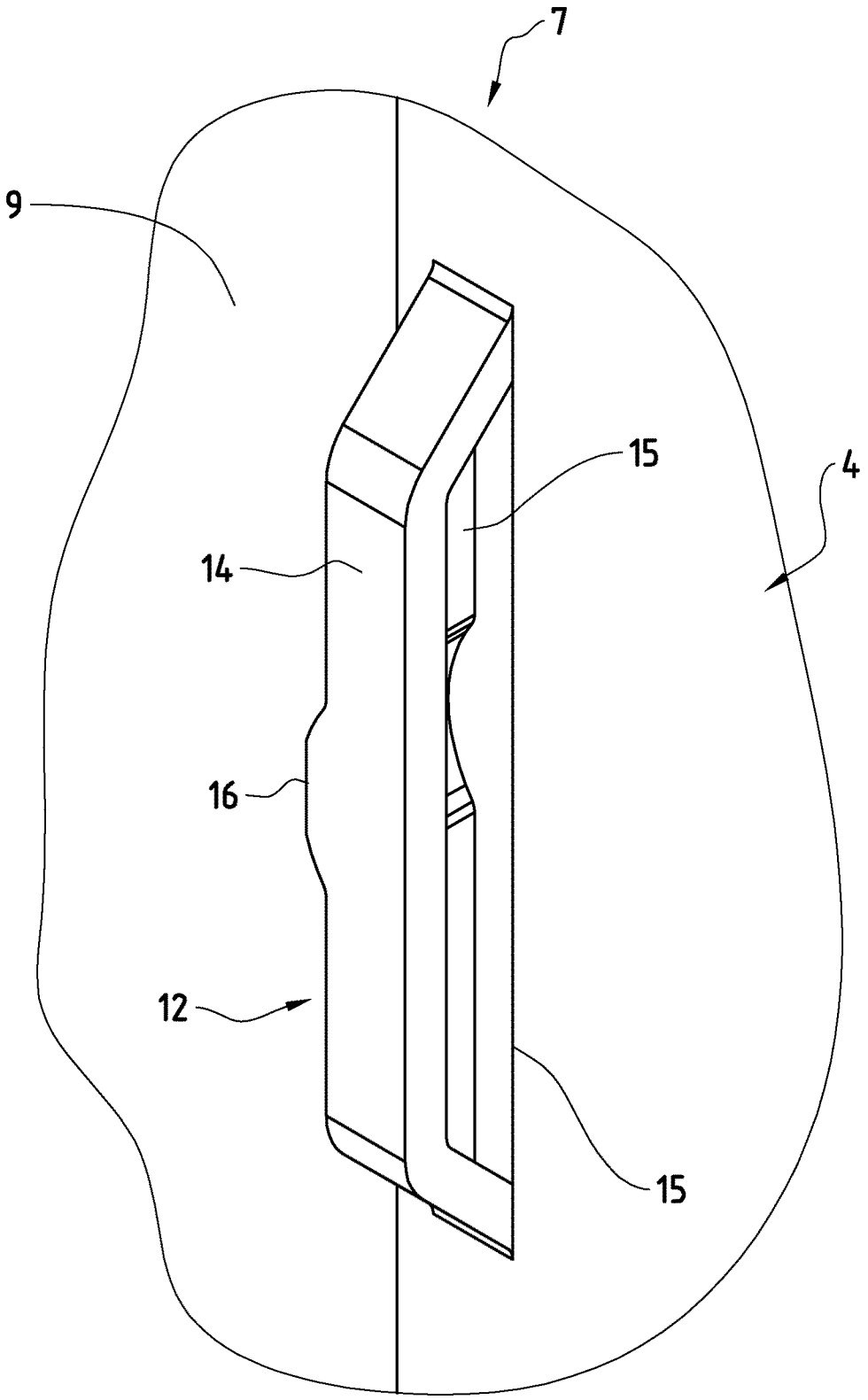
FIG. 5 shows in a spatial representation a partial view of the crosspiece forming the projecting element.

FIG. 5 shows in an enlarged representation the projecting element 12, which is provided in each of the second edge regions 4 in the corner region 7. Here too the projecting element 12 consists of a crosspiece 14, which is formed by two cuts 15 in the sheet metal forming the second edge region 4. This crosspiece 14 is again bent upward and has a protuberance 16. By means of this crosspiece 14 the plate-shaped element 9 is held in the storage compartment 1; also this crosspiece 14 can be pressed against the plate-shaped element 9, so that the plate-shaped element 9 is held in a way free of play in the storage compartment 1.

Figure 6:
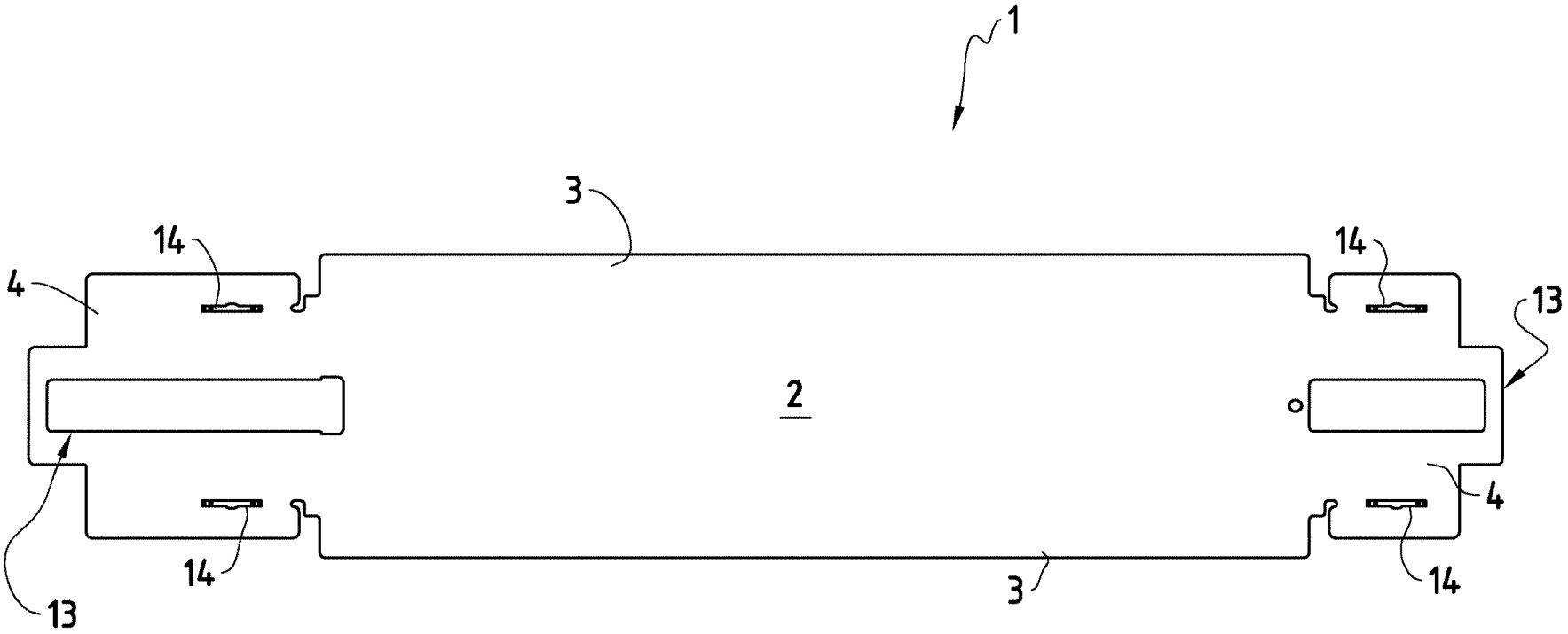
FIG. 6 shows a view of the blank of sheet metal for producing the storage compartment according to FIGS. 4 and 5.

Shown in FIG. 6 is the blank of sheet metal, out of which is formed the basic structure of the storage compartment 1 as it is shown in FIG. 4. Formed on the base part 2 are the first edge regions 3 and the second edge regions 4, which are bent upward in a known way and form the corresponding first side surfaces 5 and second side surfaces 6 (FIG. 4). Also made in this blank are the crosspieces 14 as well as the suspension devices 13. All these forms and embodiments of the blank are achieved by means of a punching process. By means of a bending process the respective regions are bent upward and the crosspieces 14 bent up. The plate-shaped elements 9 can then be inserted into the completed, bent element (FIG. 4) and can be held as described.

Shown in FIG. 7 is a third embodiment example of a storage compartment 1 according to the invention. Inserted into this storage compartment 1 is just one plate-shaped element 9, and, to be precise, on the rear end side. This storage compartment 1 again comprises a base part 2, first edge regions 3 and second edge regions 4. Provided in the second edge regions 4 is respectively a projecting element 12 only in the rear corner regions, by means of which elements the plate-shaped element 9 is held. The rest of the walls of the storage compartment 1 are formed by the two second edge regions 4 and the front first edge region 3.

As can be seen from FIG. 8, the projecting element 12 here too consists of a crosspiece 14, which is formed by two cuts 15 provided in the sheet metal of the second edge region 4, and which crosspiece 14 is correspondingly bent upward. Here too the crosspiece has a protuberance 16.

Figure 9:
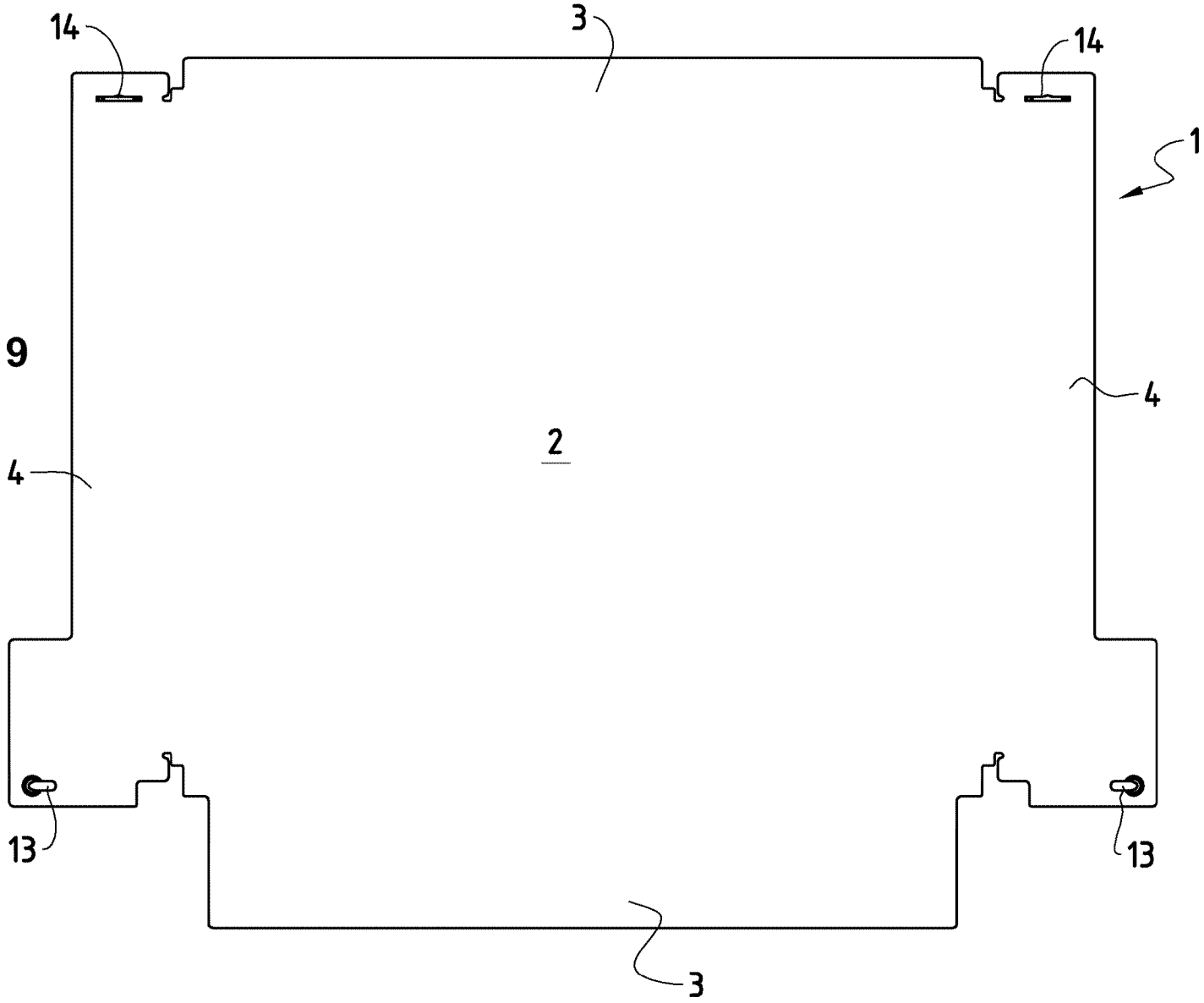
FIG. 9 shows a view of the blank of sheet metal for producing the storage compartment according to FIG. 9 <sic 7>.

FIG. 9 shows the sheet metal blank of the storage compartment 1, as it is shown in FIG. 7. Again this blank comprises a base part 2 with first edge regions 3 and second edge regions 4 provided thereon. Disposed in the rear end regions of the two second edge regions 4 is again in each case a crosspiece 14, which is able to hold firmly the inserted plate-shaped element 9 (FIG. 7). Here too, after the punching process, the respective bending steps are carried out, whereby the structure of the storage compartment 1, as it is shown in FIG. 7, are <sic. is> obtained. The suspension devices 13 comprise two slots, via which the storage compartment 1 is able to be hung on a support in two correspondingly provided hooks.

Figure 10:
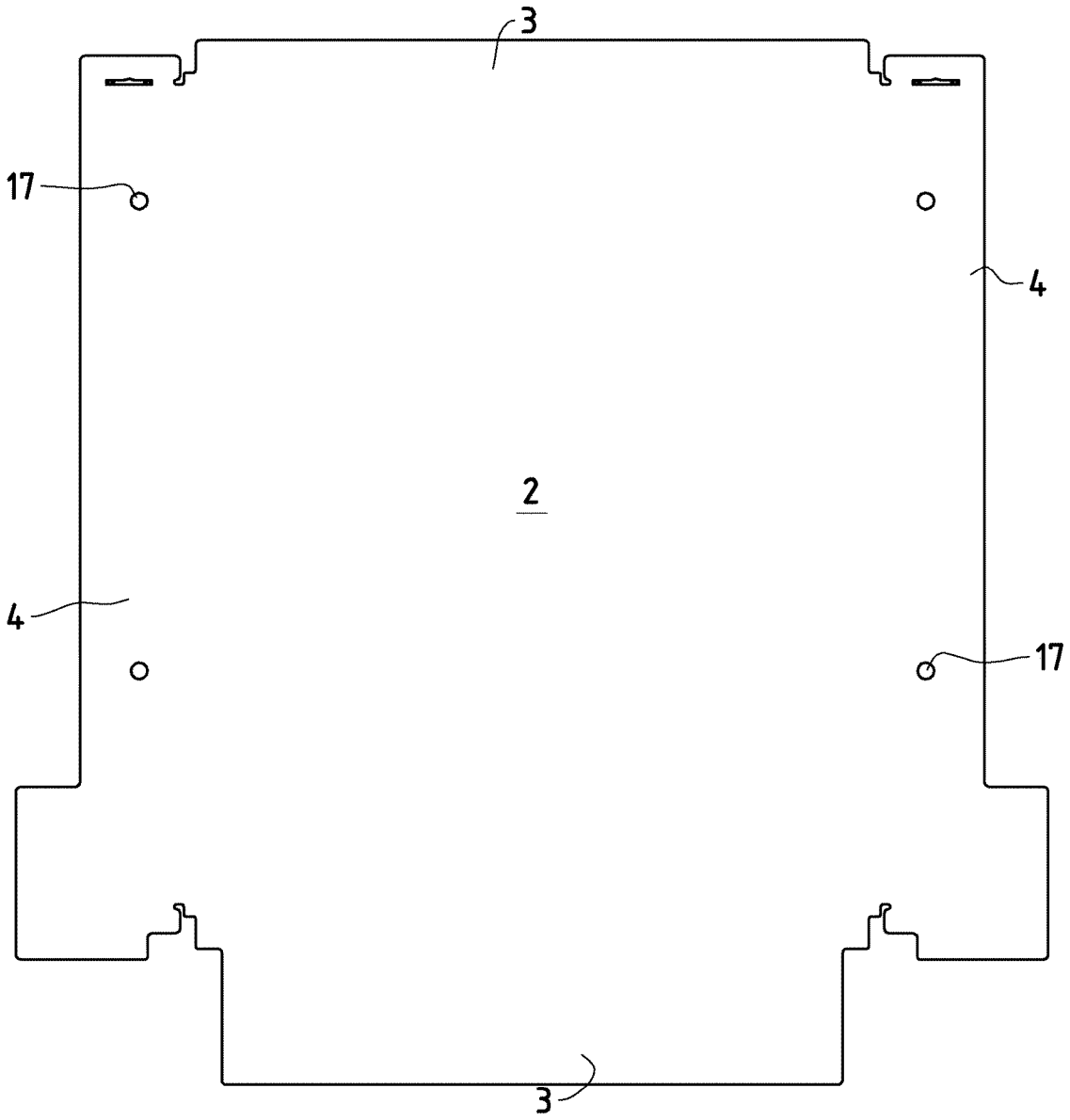
FIG. 10 is a view of a further blank of sheet metal for producing a storage compartment.

FIG. 10 shows a blank of sheet metal for a storage compartment, which is constructed in substantially the same way as the storage compartment according to FIG. 7, again comprising a base part 2 with first edge regions 3 and second edge regions 4 formed thereon. Made in the second edge regions 4 in each case are two bores 17, by means of which the storage compartment can be fixed, for example to linear guides, which can be held in a cabinet element, whereby this storage compartment, via these guides, is able to be pushed into, and pulled out of, the cabinet element.

With this design according to the invention, storage compartments can be produced in a simple way. The variety of shapes is practically unlimited. Where and in which size the plate-shaped elements are supposed to be inserted can likewise be determined practically as desired. The manufacture of these storage compartments is very simple, likewise the fixing of the plate-shaped elements, whereby through the forming of the crosspieces a holding, free of play, of the plate-shaped elements in the storage compartment can be ensured at all times. Besides the simple production, an optimal aesthetic appearance is also ensured.

The invention claimed is:

1. Storage compartment insertable into a cabinet element, the storage compartment comprising a blank of sheet metal comprising a base part and edge regions surrounding the base part, said edge regions being bent upwards by about 90° with respect to the base part, and a plate-shaped element insertable and held adjacent to one of said edge regions to form a wall of the storage compartment, a first and a second of said edge regions forming a corner region of the storage compartment and a first side surface and a second side surface of the storage compartment, the first side surface being a supporting surface for a plate side of the plate-shaped element inserted in the storage compartment, the second side surface covering a frontal surface of the plate-shaped element at least over a portion of a height of the plate-shaped element, a projecting element formed in the second side surface to capture the plate-shaped element between said supporting surface and said projecting element, wherein the projecting element is designed as a crosspiece formed by two parallel cuts made in the second of the edge regions, said cuts forming longitudinal sides of the crosspiece, wherein the crosspiece remains connected by a narrow side of the crosspiece to the second of the edge regions and the crosspiece is bent up out of the surface of the second of the edge regions.

2. Storage compartment according to claim 1, wherein the first side surface is formed by the first of the edge regions and bends provided on the second of the edge regions, and the second side surface is formed by the second of the edge regions.

3. Storage compartment according to claim 1, wherein the crosspiece is provided with a protuberance on the longitudinal side pointing toward the supporting surface of the first of the edge regions.

4. Storage compartment according to claim 1, wherein a bent-up region of the crosspiece is bendable back toward the plate-shaped element.

5. Storage compartment according to claim 1, further comprising suspension devices formed on the edge regions.

6. Storage compartment according to claim 1, wherein the metallic sheet is a chromium steel sheet.

7. Storage compartment according to claim 1, wherein the plate-shaped elements consist of wood.

* * * * *